US010526801B2

(12) United States Patent
Pelc

(10) Patent No.: US 10,526,801 B2
(45) Date of Patent: Jan. 7, 2020

(54) ELONGATED CAM, SELF-LOCKING, BOARD STRAIGHTENING DEVICE

(71) Applicant: THE IPE CLIP FASTENER COMPANY, LLC, Bradenton, FL (US)

(72) Inventor: Robert J. Pelc, Sarasota, FL (US)

(73) Assignee: THE IPE CLIP FASTENER COMPANY, LLC, Bradenton, FL (US)

( * ) Notice: Subject to any disclaimer, the term of this patent is extended or adjusted under 35 U.S.C. 154(b) by 263 days.

(21) Appl. No.: 14/886,693

(22) Filed: Oct. 19, 2015

(65) Prior Publication Data

US 2016/0039111 A1 Feb. 11, 2016

Related U.S. Application Data

(63) Continuation of application No. 14/600,513, filed on Jan. 20, 2015, now abandoned, which is a continuation-in-part of application No. 12/687,373, filed on Jan. 14, 2010, now Pat. No. 8,936,054.

(60) Provisional application No. 61/145,265, filed on Jan. 16, 2009.

(51) Int. Cl.
*E04F 21/22* (2006.01)
*B25B 5/08* (2006.01)

(52) U.S. Cl.
CPC ..... *E04F 21/22* (2013.01); *B25B 5/08* (2013.01)

(58) Field of Classification Search
CPC ... B27H 1/00; E04F 21/22; B25B 5/08; B25B 5/082; B25B 5/085; B25B 5/087
USPC ..... 144/269, 270, 271; 269/208, 269; 254/11–17
See application file for complete search history.

(56) References Cited

U.S. PATENT DOCUMENTS 77,610 A * 5/1868 Hall ..... E04F 21/22 254/17
618,573 A * 1/1899 Ingersoll ..... E04F 21/22 254/16
5,269,494 A * 12/1993 Pittman ..... B25B 5/08 254/17
5,478,050 A * 12/1995 Ott ..... E04F 21/22 254/17
5,605,319 A * 2/1997 Reiley ..... B25B 5/08 254/17
7,516,943 B1 * 4/2009 Haut ..... E04F 21/22 254/131

(Continued)

*Primary Examiner* — Matthew Katcoff
(74) *Attorney, Agent, or Firm* — Law Office of Alozie N. Etufugh PLLC

(57) ABSTRACT

A board straightening tool comprising a handle non-rotatably attached to a cam rotatably attached to a locking dog provides force to straighten boards by grasping the joist supporting the tool and simultaneously wedging a shoulder of the cam against the board being fastened to the joist, and maintains a space between tool and board for edge-mount fasteners. Increased force against the board is provided by a fulcrum action of the cam to locking dog rotatable attachment and is maintained by locking the cam in place using a specially designed curved cam perimeter section that enables an installer to straighten a deck board while keeping his hands free. Locking dog locking fingers are constructed from a knurled metal for grasp power or of a smooth surface to reduce marring the joist. The tool also provides the force required to maintain consistently spaced gaps between the boards for a more desirable appearance.

19 Claims, 13 Drawing Sheets

20

(56) References Cited

U.S. PATENT DOCUMENTS

2005/0247019 A1* 11/2005 Pasto ..... E04F 21/22
52/749.12

* cited by examiner

20

20 current locking dog slot example for moving dowels (locking fingers)

current preferred multi radius design examples of various multi radius cam design our tool applies force both perpandicular and angular so it jams the ends of deck boards togerth as well as straightening the deck board.

ELONGATED CAM, SELF-LOCKING, BOARD STRAIGHTENING DEVICE

CROSS-REFERENCE TO RELATED APPLICATIONS

This Application is a Continuation of Continuation-In-Part application Ser. No. 14/600,513 filed Jan. 20, 2015, which claims the benefit of U.S. Non-Provisional application Ser. No. 12/687,373 filed Jan. 14, 2010, which claims the benefit of U.S. Provisional Application No. 61/145,265, filed Jan. 16, 2009.

STATEMENT REGARDING FEDERALLY SPONSORED RESEARCH OR DEVELOPMENT

Not Applicable

REFERENCE TO SEQUENCE LISTING, A TABLE OR A COMPUTER PROGRAM LISTING COMPACT DISK APPENDIX

Not Applicable

FIELD OF INVENTION

The present invention relates generally to woodworking tools and, more particularly, to a board straightening tool that enables a single installer to simultaneously straighten and position each board that is being installed, and to maintain a clearance required by edge-mount fasteners, alternatively, the tool enables a single installer to bend a board into a curved shaped to achieve a decorative curved pattern.

BACKGROUND

The background information discussed below is presented to better illustrate the novelty and usefulness of the present invention. This background information is not admitted prior art.

More and more frequently the lumber that is used to make for framing, decking, and fencing is harvested from fast-growing, young trees. In general, lumber garnered from young trees is less stable than old-growth tree lumber and produces boards that tend to be crooked, bowed, or twisted and must be straightened before they can be used.

SUMMARY

The straightening device tools made according to the principles of the present invention provide the force required for a single installer to straighten bent or crooked boards, including very hard boards. Once the tool has been positioned to provide the force required, it is essentially locked into that position avoiding slipping out of the position of maximum force. Each tool simultaneously maintains a grasping connection to both the joist being used to support the tool and to the board being fastened to the joist. Additionally, and importantly, each tool maintains a clearance between itself and the board being fastened to the joists so that an edge-mount board-fastener can be used to provide for an installation to be completed by a single installer. The clearance is also necessary for an installer to install the board-fastener on the same joist that is supporting the tool in order to obtain the straightest possible installed boards and, importantly, to maintain the maximum straightness of the deck board after the straightening device is released.

The principles of the present invention were conceived when the Inventor realized that what he had to work with are the currently available deck boards milled almost exclusively from fast growing juvenile wood culled from the second- and third-growth trees and, thus, are inherently less dimensionally and linearly stable resulting in boards that remain straight only as long as they remain wet, but upon drying are likely to shrink and/or swell. The Inventor recognized that the warping of the young wood creates problems, for all who must use this wood. Although drying the wood, using either air drying or kiln drying, eliminates, or at least significantly reduces, much of the young wood warping, the drying process substantially increases the time and, in many cases the energy costs, thus, increasing the cost of the lumber. Moreover, kiln drying processes create "drying stresses" on the boards being dried causing boards that were straight when originally cut to become bent and crooked upon the rapid heat induced drying. Kiln dried wood adds an additional and considerable increase in the total cost of lumber due to the extreme force required to straighten boards bent by the kiln drying process. For reasons, such as these, the use of un-dried, young, green wood continuously increases. Not only is young, green wood initially less expensive than dried young wood or more mature wood, it also accepts nails easier than older, stronger wood. Green wood, however, because it is rarely perfectly straight requires straightening before, or during, installation in order to achieve a quality installation that includes consistent spacing between each pair of adjacent floor boards, in addition to straight and true pattern alignments. Moreover, there has been an increased use of imported tropical woods by both residential and commercial industries. Although tropical timbers have drastically greater bending and resistance/strength than traditional pressure treated pine boards, today's tropical lumber often arrives bent and with many of the same imperfections of non-tropical wood. The increased strength of tropical wood requires an increased force from board straightening devices in order to straighten the tropical wood deck boards during installation. The present Inventor recognized that existing board straightening devices are not able to apply the amount of directional force required to straighten a board because they are not able to, simultaneously, grasp the joist to which the board is being attached and to provide adequate pushing and straightening leverage on the board without slipping. Moreover, the thickness of framing joists can vary significantly depending on such factors as their source and the size needed to provide the strength required for a particular purpose, and while some currently available devices are simply unable to adjust for thickness, others must rely upon additional, and rather clumsy, attachments to accommodate different thicknesses. Such devices also preclude the use of an edge-mount fastener on the same joist that is being straightened, which reduces the ability of the fastener to hold the board at maximum straightness after the straightening device of the present invention is released. The use of presently available tools often results in damage to, or marring of, the structural joist that they are leveraged on, damage of, or marring to, the deck board being straightened, an inability to apply the force required to straighten the crooked boards, and/or the tools slipping away from the desired direction of force as they lack the necessary mechanical engineering to provide a rigid enough hold onto the joist that is being used to apply leverage force.

The present inventor further recognized that the deficiencies of currently available tools are due to their design mechanics. These tools were designed when softwood decking that is easily bent (i.e., straightened) was the norm. And, traditionally, face-mounted fasteners do not require a clearance space between the straightening device and the edge of the board, as does the installation of recently invented edge-mount fasteners that are quickly becoming the norm in modern board fastening. The present Inventor recognized that the increasing use of the edge-mount fasteners, such as his Ipe Clip® edge-mount, hidden deck fasteners, is increasing the need for a straightening tool that provides space between itself and the board being straightened and installed to enable the installation of the edge-mount fasteners. Additionally, the present Inventor wanted a straightening tool capable of providing a higher than typically available force against boards that require straightening, especially tropical hardwood deck boards. This force is needed to hold the boards straight while the edge-mount fastener is installed between the straightening device and the deck board.

Accordingly, the Inventor developed an inventive concept enabling the creation of a cost-effective straightening tool that provides greater straightening force than is presently available and is able to maintain the force without fear of the tool slipping; provides for space between the tool and the board enabling a single installer the ability to straighten a deck board while keeping his hands free to, for example, install and lock in place an edge-mount fastener to hold the board at maximum straightness after the straightening device is removed; and does not damage or mar either the structural joist or the board being straightened. Additionally, the adjustable grasping pins (locking fingers) according to the principles of the inventive concept provide a unique built-in adjustability to accommodate varying joist sizes and allow for boards to be straightened regardless of whether they are perpendicular or at an angle to the joist. The adjustable pins are also offered in a knurled metal providing for the tool to grasp onto the joist more firmly, and, thus enabling an increase in the amount of bending force that can be applied, alternatively the pins may be provided as smooth pins to reduce marring of joist where the ascetics of the framing structure is exposed.

It is important to note that these advantages do not rely on the combination of old elements according to their established functions to achieve a desired effect. These advantages were obtained by a unique design of the tool itself, as will be explained in detail below. The kinds of innovative engineering decisions used in the deliberations that had to be made to achieve the effects sought are not within the level of ordinarily skilled artisans. The tool, according to the principles of the present invention, is herein described in its use for straightening and installing wooden deck boards, but can also be used on composite, plastic, and tongue and groove decking, as well as on plywood sub-floors, sheet goods, and wall and ceiling applications.

To apply and maintain a higher than typically available force against a board that requires straightening, the present invention provides for an offset oblong shaped cam having a uniquely shaped perimeter of various lengths and arcs of curves and sections that are either straight or otherwise perform the same function as a straight section to eliminates the danger of an installer pushing the tool lever past the point of maximum force exertion, which occurs when using currently available devices. Thus, the part of the cam that mimics a key bow includes at least one convexly rounded corner perimeter section to provide for additional force to be applied at the point of contact (the "sweet spot") between the board and the tool that provides the force required for board straightening. This unique cam design of the present invention increases the scissor-like compression against the joist to allow for maximum holding pressure and a reduction of slippage of the tool on the joist, therefore allowing for maximum force to be applied to the board being straightened. Adjacent to the at least one convexly rounded corner perimeter section, there is, in one example, a straight perimeter section to keep the tool from slipping past the sweet spot, and adjacent to and following the straight perimeter section there may be a second curved perimeter section. As explained just above, the "shoulder" of the key-bow section of is a convexly rounded perimeter section to increase the holding force of the tool when the tool is attached to a joist. A straight-edged perimeter section, in one example, acts as a brake to reduce chances of the tool slipping off of the joist, which is a frequent occurring problem with currently available board straightening devices. It should be understood that to apply and maintain a higher than typically available force against a board that requires straightening, the tool of the present invention can be locked (i.e., prevented from moving out of position) in the position when the cam is applying the greatest force against the board being straightened. It is thus obvious that an important principle of the inventive concept deals with maintaining (i.e., locking) the tool in the position where it is exerting maximum force against the board. This principle inherently includes, by the fundamental laws of physics, having either straight portions on the cam, concave curved portions, or by this portion having a curvature of radius increased to a point that produces a portion of the perimeter that cannot be mathematically straight but yet, looks and acts like a straight section. Thus, it is clear that the inventive concept requires the cam to have a curved shoulder perimeter section adjacent a perimeter section that will prevent the tool from slipping past the spot of greatest application of force by the tool.

All of the above described benefits and innovations are made possible by providing for a straightening tool that comprises a handle non-rotably attached to a key-shaped cam, the key-shaped cam having a perimeter of various lengths of arc and various lengths of straight or otherwise shaped sections that prevent slippage, the cam being rotatably attached to a locking dog, the locking dog having grasping pins extending from an opposing surface, the handle, the cam, the locking dog, and the grasping pins so arranged to increase the scissors-like compression of the tool against the joist to allow for maximum holding pressure and a reduction of slippage of the tool on the joist.

The principles of the present invention also provide a board straightening tool constructed of a handle attached to a cam, the cam attached to a locking dog, the locking dog having grasping pins extending from an opposing surface, the handle, the cam, the locking dog, and the grasping pins so arranged for the tool to simultaneously maintain a grasping connection to both the joist being used to support the straightening device and the board being fastened to that joist and to maintain a clearance between the board and straightening tool for the installation of an edge-mount board fastener providing for a single installer to simultaneously straighten and install a board to a joist.

The invention principles further comprise the handle detachably and non-rotably attached to the cam, wherein the handle is able to be detached and reattached in a non-rotatable attachment to be used in 180 degree directionally opposite positions, and wherein the handle is adjustable to be positioned for use in multiple varying degrees from the tool body.

The invention principles further comprise the cam having a curved perimeter shoulder section adjacent a straight perimeter section preventing the tool from slipping past the spot of greatest application of force by the tool, furthermore the cam further comprises a uniquely shaped perimeter of various lengths and arcs of curves and sections that prevent slippage of the cam past the sweet spot, and the cam having an offset rotable attachment to a locking dog.

The invention principles still further comprise the grasping pins being positionably adjusted to grasp varying joist sizes to stabilize the locking dog so that when the rounded perimeter part of the cam is wedged against the board the offset rotable attachment acts as a fulcrum to multiply the force that an installer applies to the handle. If desired, the grasping pins may be constructed from a knurled metal for a tighter hold made possible by a surface of greater friction, or being made with a smooth surface providing for a reduction of marring of the joist.

The invention principles further comprise a board straightening tool constructed of a handle fixedly, detachably, and non-rotably attached to a cam, the cam having a curved perimeter section adjacent a perimeter section that will prevent slippage and having an offset rotable attachment to a locking dog, the locking dog having grasping pins extending from an opposing surface, the handle, the cam, the locking dog, and the grasping pins so arranged for the tool to provide a single installer to simultaneously straighten and install a board to a joist while maintaining a clearance between the board and the straightening tool for the installation of an edge-mount board fastener.

There is outlined, rather broadly, the more important features of the invention in order that the following detailed description thereof may be better understood, and in order that the present contribution to the art may be better appreciated. Those skilled in the art will appreciate that the conception, upon which this disclosure is based, may readily be utilized as a basis for the design of other structures, methods and systems for carrying out the several purposes of the claimed invention. Still other benefits and advantages of this invention will become apparent to those skilled in the art upon reading and understanding the following detailed specification and related drawings. It is important, therefore, that the claims be regarded as including such equivalent constructions in so far as they do not depart from the spirit and scope of the claimed invention.

BRIEF DESCRIPTION OF THE DRAWINGS

In order that these and other objects, features, and advantages of the present invention may be more fully comprehended and appreciated, the invention will now be described, by way of example, with reference to specific embodiments thereof which are illustrated in appended drawings wherein like reference characters indicate like parts throughout the several figures. It should be understood that these drawings only depict preferred embodiments of the present invention and are not therefore to be considered limiting in scope, thus, the invention will be described and explained with additional specificity and detail through the use of the accompanying drawings, in which.

Figure 1:
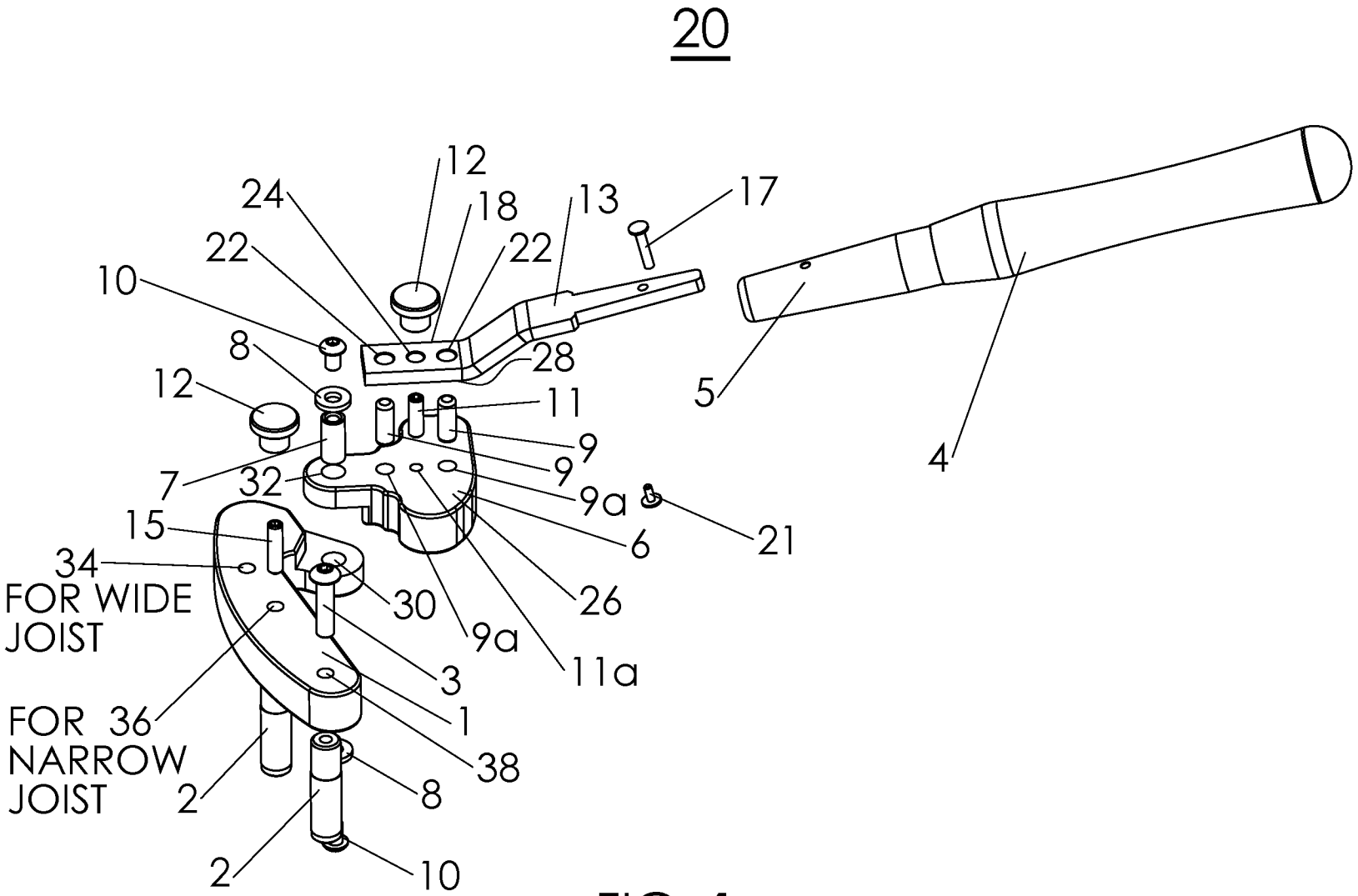
FIG. 1 is an exploded view of the present invention.

It should be understood that the drawings are not necessarily to scale. In certain instances, details which are not necessary for an understanding of the present invention or which render other details difficult to perceive may have been omitted.

LIST OF REFERENCE NUMERALS AND THE PARTS TO WHICH THEY REFER

1 Locking dog.
2 Textured dowel pin locking fingers (grasping pins).
3 Button head screw.
4 Wooden handle.
5 Ferrule.
6 Cam.
6*a*-6*d* Alternative cam designs.
7 Offset pivot pin.
8 Hardened washer.
9 Dowel pin.
9*a* Apertures accepting dowel pins 9.
10 Button head screw.
11 Threaded insert.
11*a* Aperture accepting threaded insert 11.
12 Threaded knob.
13 Handle adapter.
14 Floor boards.
15 Treaded insert.
16 Support studs (joists).

17 Binding post.
18 Handle adapter 13 tab extension with apertures 22 and 24.
19 Partially built deck floor.
20 Straightening tool.
21 Screw.
22 Apertures.
24 Aperture.
26 Surface of cam 6.
28 Surface of handle adapter 13.
30 Aperture.
32 Aperture.
34 Aperture.
36 Aperture.
38 Aperture.
40 Sliding slot into which locking fingers may be secured.
52 A rounded shoulder section of the perimeter of cam 6.
54 A perimeter section of cam 6 that acts to lock the cam in place.
56 An optional second curved perimeter section of cam 6.
60 A head or bow section of cam 6.
62 A truncated keyway section of cam 6 from which extends head or bow section 60 of cam 6.
64 A perimeter section of cam 6 that acts to lock the cam in place not having an optional second curved perimeter section.
66 A truncated perimeter section of cam 6.
68 A concavely curved perimeter section of cam 6 that acts to lock the cam in place.

Definition

Radius of curvature (R) at a given point on a curve is the radius of a circle that mathematically best fits the curve at that point. The radius of a straight line has an infinite value. The radius of a convex curve has a positive value. The radius of a concave curve has a negative value.

Curvature is the reciprocal of the radius, so that a smaller curvature implies a large radius.

Board, as used herein includes wooden boards, bamboo, barn board, plywood, LSB, particle board, composite, engineered boards including plastics, such as vinyl and the like, and any other plank type of material that requires straightening.

DETAILED DESCRIPTION

Referring now, with more particularity, to the drawings, it should be noted that the disclosed invention is disposed to embodiments in various sizes, shapes, and forms. Therefore, the embodiments described herein are provided with the understanding that the present disclosure is intended as illustrative and is not intended to limit the invention to the embodiments described herein.

Figure 11:
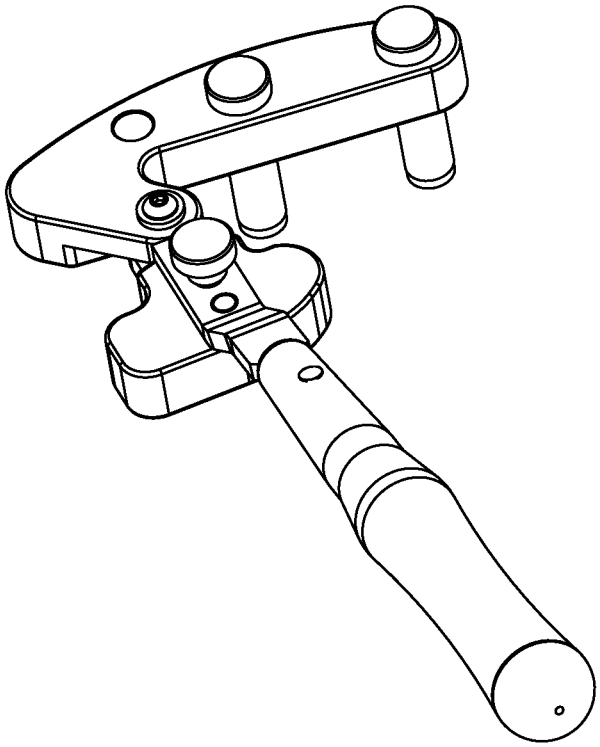
FIG. 11 is a perspective view illustrating tool in its 0° degree position for left hand use.
Figure 12:
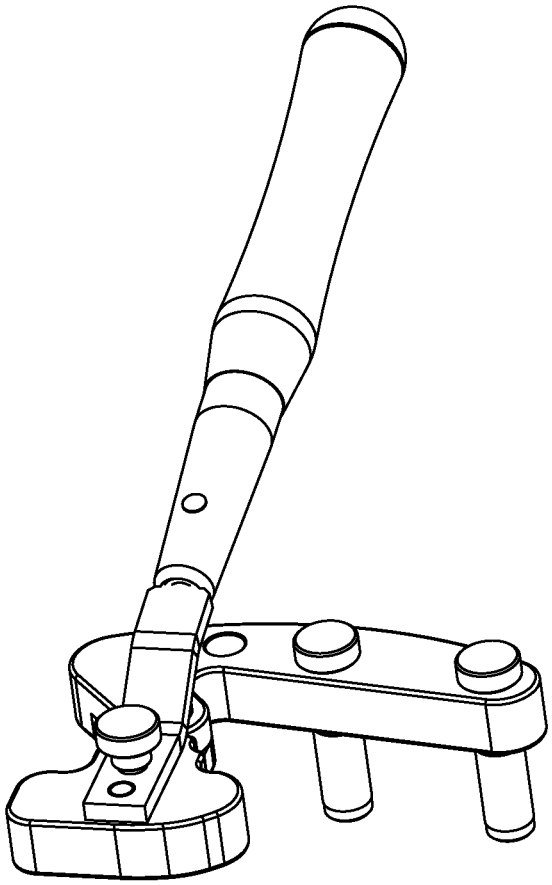
FIG. 12 is a perspective view illustrating tool in its 180° degree position for left hand use.

Turning now to the drawings, FIG. 1, an exploded view of an example of the present invention, illustrates one way to make straightening tool 20 according to the principles of the present invention. Ferrule 5 (a tang sleeve) on wooden handle 4 accepts one end of adapter 13 to form a secure attachment therewith. Binding post 17 is inserted through a receiving aperture in ferrule 5 into wooden handle 4 and then into a receiving aperture in handle adapter 13, and is held securely in place by screw 21 (note: the screw could be any attachment means that works to perform the same function). It is to be appreciated that there are many ways that this attachment may be made; for example, a rivet could be used in place of the screw and post method. Handle tab 18 extends from the second end handle adapter 13. Three apertures, two end apertures 22 and center aperture 24, extend through tab 18 of handle adapter 13. Three corresponding apertures, two spaced apertures 9*a* and one center aperture 11*a*, extend through cam 6. One end of each of dowel pins 9 and one end of center threaded insert 11 are each secured in the two end apertures 22 and center aperture 24, respectively, through surface 28 of tab 18. The opposing end of each of dowel pins 9 and center threaded insert 11 are secured in the two end apertures 9*a* and center aperture 11*a*, respectively, through surface 26 of cam 6. After threaded insert 11 has been accepted through aperture 24, threaded knob 12 is threaded onto threaded insert 11 to secure the handle to cam 6. Installation of the first board requires using the straightening tool handle in its reversed position; else the handle will interfere with the structure that extends above the board. Handle 4 is easily directionally reversed by unscrewing threaded knob 12, lifting handle tab 18 off of dowel pins 9, rotating handle tab 18 so that the handle extends in a diametrically opposed direction from that which it had, and screwing knob 12 back into place (See FIGS. 11 and 12). Handle 4 may be easily and rapidly adjusted so that the tool provides for either right hand or left hand use by removing the handle and rotating it to its opposite side, remover dowel pins 2 from locking dog, rotate those diametrically and reassembling the tool.

Figure 6A:
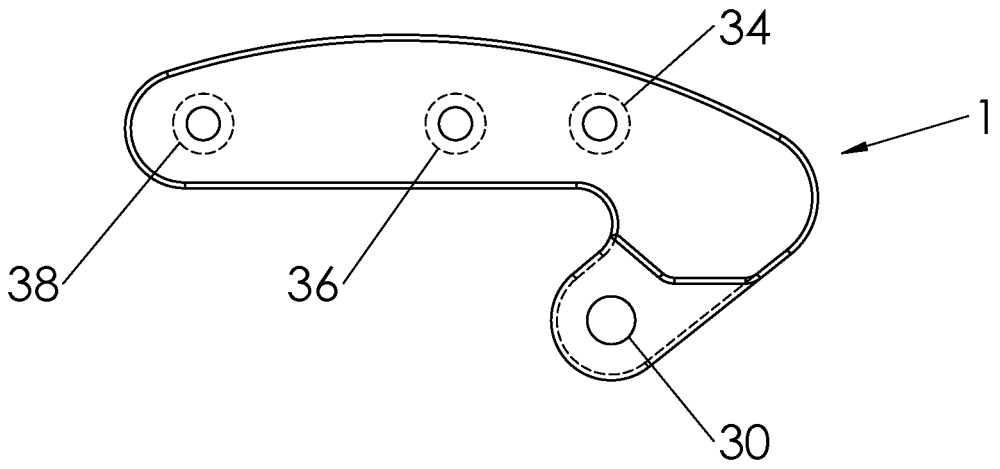
FIG. 6*a* is a plan view showing one style of locking dog construction of the present invention.
Figure 6B:
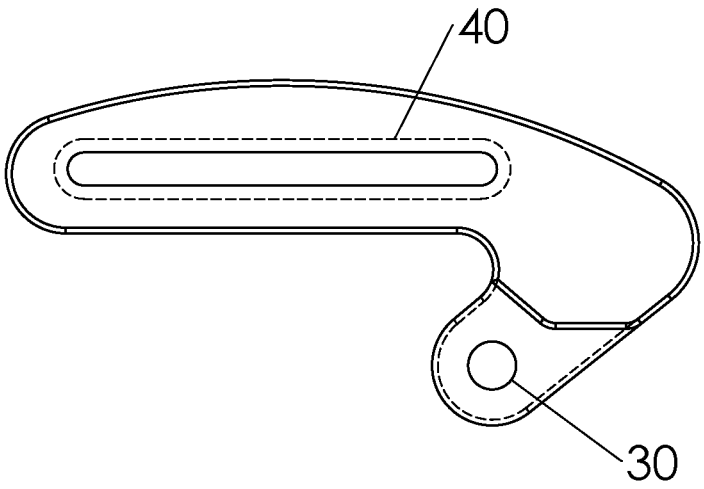
FIG. 6*b* is a plan view showing another style of locking dog construction of the present invention.
Figure 7A:
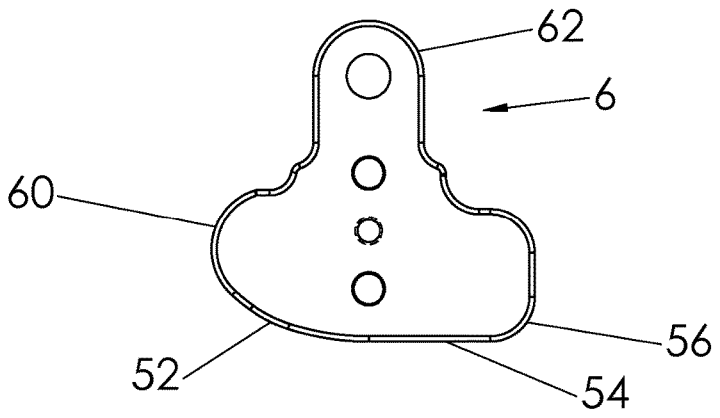
FIG. 7*a* is a plan view showing one style of cam construction of the present invention.
Figure 7B:
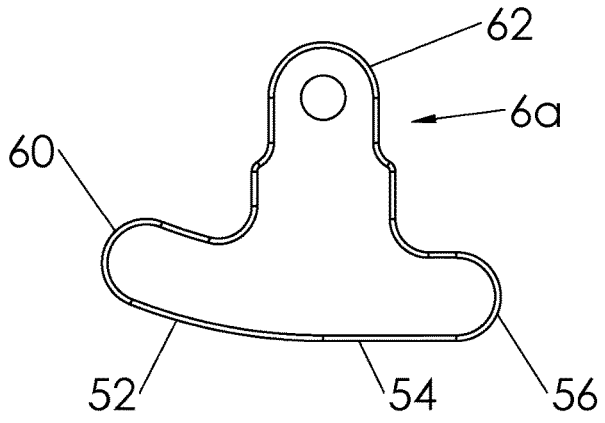
FIG. 7*b* is a plan view showing another style of cam construction of the present invention.
Figure 7C:
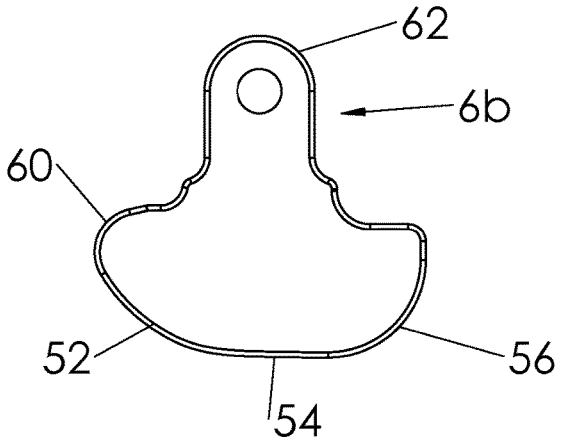
FIG. 7*c* is a plan view showing yet another style of cam construction of the present invention.

Offset pivot pin 7 extends through aperture 32 of cam 6 into aperture 30 of locking dog 1 and is held securely in place by hardened washer 8 and button head screw 10. Locking dog 7 prevents movement by offering physical obstruction or engagement of some kind. Locking dog 7 may hold an object in place by blocking, clamping, or otherwise obstructing its movement. Offset pivot pin 7 rotatably secures locking dog 1 (see also FIG. 6*a*) to cam 6. Dowel pins 2 serve as "locking fingers" or grasping pins to grasp and lock onto either a narrow or wider joist. In the drawings of FIG. 1, two dowel pins 2 are shown. Stationary pin 2 is held in place in aperture 38 of locking dog 1 by button head screw 3. Moveable pin 2 may be detachably attached in aperture 36 of locking dog 1 by threaded insert 15 and threaded knob 12 so that locking fingers 2 can be adjusted for grasping a narrow joist. When moveable pin 2 is moved from aperture 36 to aperture 34 and secured again by threaded insert 15 and threaded knob 12, locking fingers 2 are positioned for grasping and locking onto a wider joist. A series of additional spaced apertures (not shown) will accommodate joist of a variety of widths. It should be understood that many of the features of the present invention may be modified and still maintain the concept of the invention. For example, locking dog 1 and its locking fingers 2 may be formed so that the locking fingers are adjusted with respect to each other by being moved to various positions in a sliding slot 40, as illustrated in FIG. 6*b*, instead of one, or alternatively both, fingers being removed and repositioned on the locking dog. In this embodiment locking fingers 2 are constructed from dowel pins that have been knurled and/or textured to provide greater gripping force. The offset of pivot pin 7, with respect to both the locking dog and the cam, provides the access required to install the locking finger dowel pins about the joist against which the straitening tool is to be braced. With locking dog 1 stabilized about a joist by locking fingers 2 and with a convex "bulge" curved shoulder of the key bow part 60 of cam 6 wedged against the board that is to be simultaneously straightened and installed, pivotable attachment offset pin 7 acts as a fulcrum in conjunction with the shoulder of the cam to multiply the force that an installer applies to handle 4, thus, increasing the force being applied to the board.

Figure 8A:
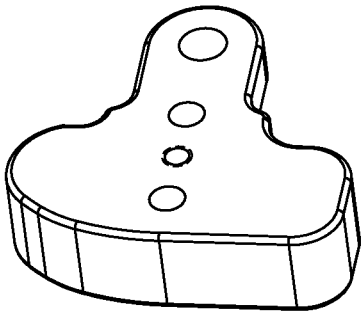
FIG. 8*a* is a perspective view illustrating how the stylized shape of the cam perimeter ensures that the sweet spot is not bypassed.
Figure 8B:
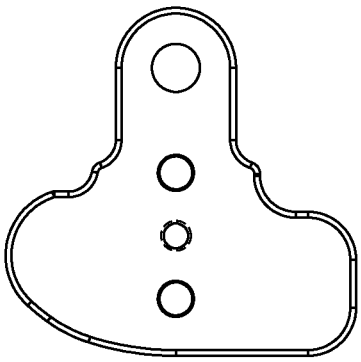
FIG. 8*b* is a plan view illustrating how the stylized shape of the cam perimeter ensures that the sweet spot is not bypassed.
Figure 8C:
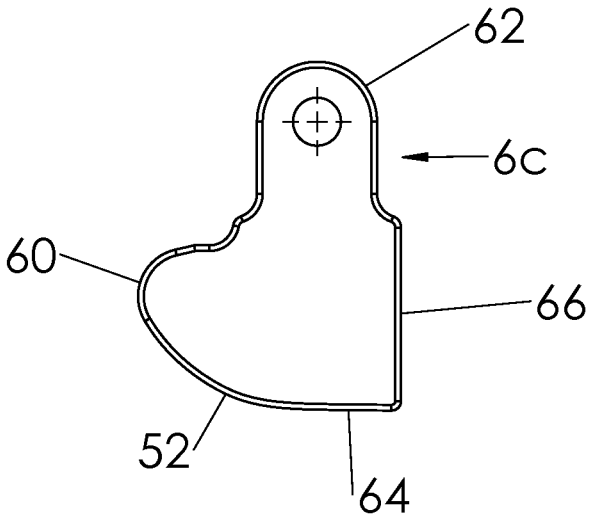
FIG. 8*c* is a plan view illustrating a cam with a single continuous curve.
Figure 8D:
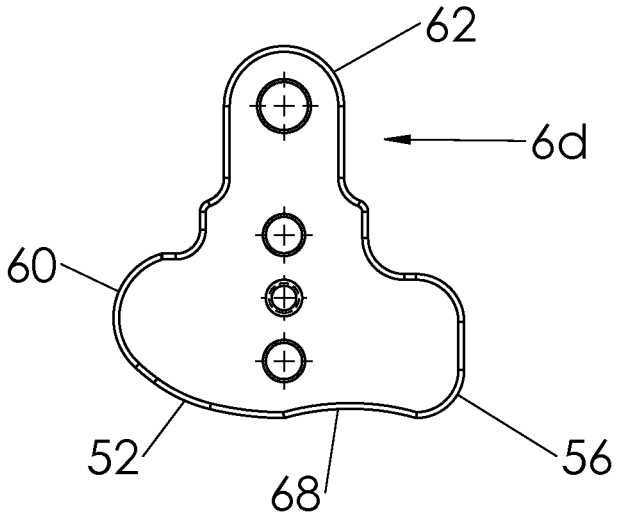
FIG. 8*d* is a plan view illustrating a cam with a convex and concave curve on the perimeter.
Figure 9:
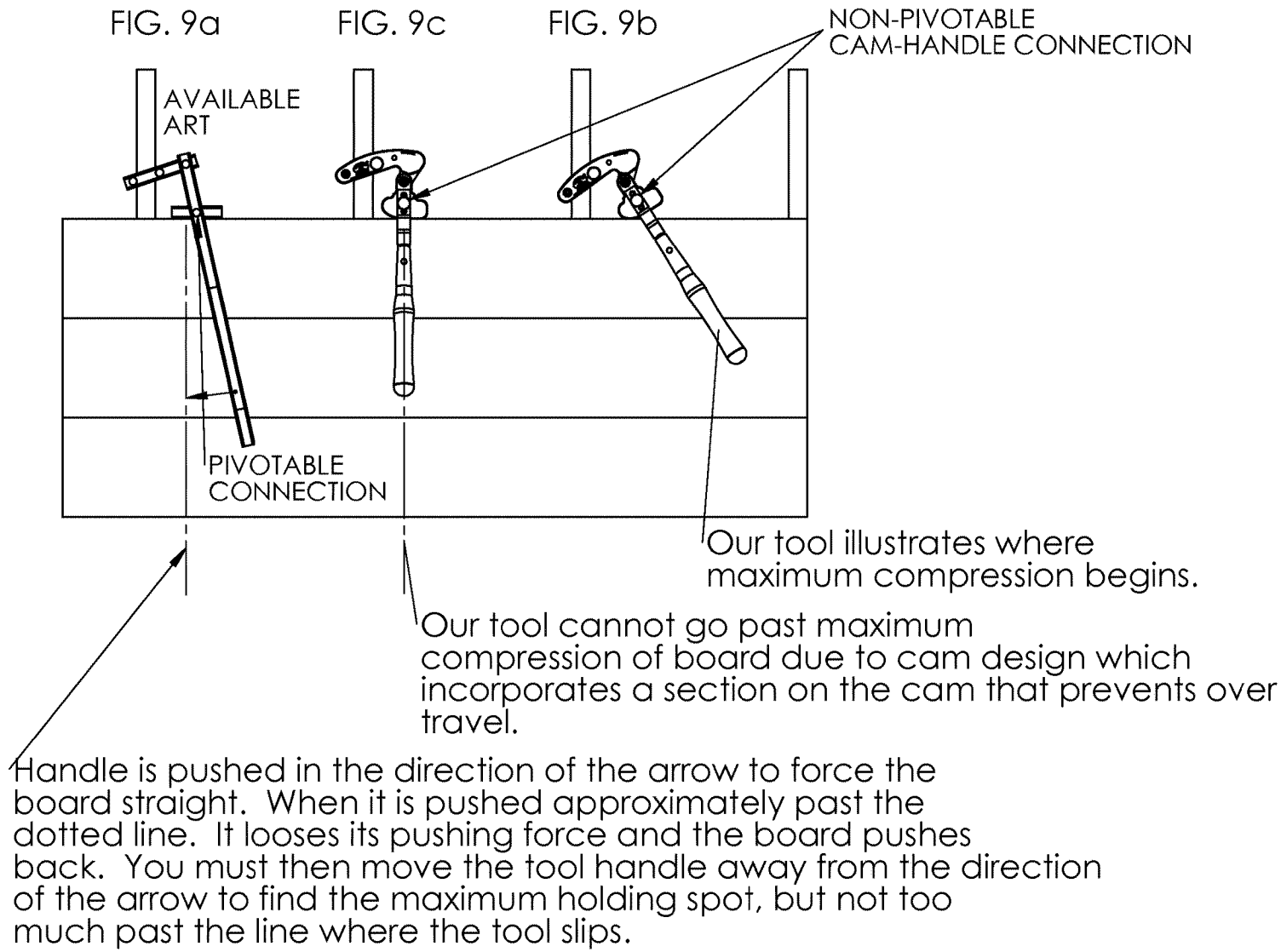
FIG. 9*a* is a plan view illustrating how the cam perimeter of currently available art ensures that the sweet spot can be bypassed.
FIG. 9*b* is a plan view illustrating where on the curved section of the cam's perimeter maximum compression begins.
FIG. 9*c* is a plan view illustrating how the straight section of the cam's perimeter that follows the curved section of the perimeter provides for the sweet spot to be reach and recognized, but not bypassed.

Shoulder perimeter section 52, having a positive radius, is by design the first part of the cam that comes into contact with the board being straightened after locking dog 1 is stabilized about the joist by locking fingers 2 (see FIG. 9*b*). Shoulder section 52 can then act in concert with the fulcrum action of pivotable offset pin 7 to multiply the force an installer applies to handle 4 to result in an increased force felt by the board. This point of maximum force is called the "sweet spot". The increased force against a board to be straightened is maintained by locking the tool to prevent it from slipping out of position. The ability to lock the tool is made possible by the design of that part of the perimeter (64 or 68) that is immediately adjacent to the bulging outward, convexly-rounded shoulder section 52. It is thus obvious that an important principle of the inventive concept deals with maintaining (i.e., locking) the tool in the position where it is exerting maximum force against the board. This principle inherently includes, by the fundamental laws of physics, having the portion of the cam's perimeter that is directly following and adjacent to the bulging outward, convexly-rounded shoulder section 52 designed to act as a brake to prevent slippage of the tool past the sweet spot. Such designs include straight portions on the relevant perimeter of the cam, concave curved portions on the relevant perimeter of the cam, or by having a curvature of radius increased to produce a portion that cannot be described as straight but yet, looks and acts like a straight section on the relevant perimeter of the cam. Thus, it is clear that the inventive concept requires the cam to have a curved shoulder perimeter section adjacent a perimeter section that will prevent the tool from slipping past the spot of greatest application of force by the tool. Accordingly, the examples illustrated in FIGS. 7*a*-7*c*, 8*c*, and 8*d* show various design variations of the perimeter of key-bow part 60 of the cam. Note that each shape is designed to prevent the cam from slipping past its sweet spot when the tool is being used to straighten a board. Each design starts with the shoulder being a bulging, convexly curved perimeter portion to increase the force applied to the handle followed by an adjacent perimeter section that prevents any further motion of the cam (see FIGS. 8*a*, 8*b* and FIG. 9*c*). In each of FIG. 7*a*-7*c* the cam has a shape that is roughly that of a household key having head or bow 60 from which extends truncated keyway 62. These figures illustrate a cam with convexly rounded key bow shoulder section 52 followed by, and adjacent to, perimeter section 54 that keeps the tool from slipping past the sweet spot. Perimeter section 54 appears to be a straight-line section. Perimeter section 54 could be a straight section, although it does not have to be a straight section. It could be a curved section having its length of radius such that the section appears to be straight. Adjacent to and following perimeter section 54 is optional second curved perimeter section 56 each showing perimeters curved to have radii of a variety of lengths. As explained just above, while convexly rounded shoulder section 52 increases the holding force of the tool when the tool is attached to a joist, perimeter section 54 acts as a brake to stop the tool from slipping off of the joist, which is a frequent occurring problem with currently available board straightening devices. If the pivotably attached handle of currently available tools is used as a fulcrum the tool would likely slip off of the joist and the cam would slip off of its "sweet spot. If this should be able to occur, the board would revert to being bent, causing the user to have to reposition the tool in a slightly different distance from the deck board and try again. This trial and error would have to be repeated until the proper alignment position was found. The tool, as taught herein, eliminates these need for multiple attempts. Slippage of presently available straightening tools limits their straightening force and reduces the handle's pushing distance, thus limiting the amount of bow that can be removed from a board. The device of the present invention removes a much higher degree of bow from a board as it maximizes the mechanical pushing distance. FIGS. 8*c* and 8*d* illustrate two additional similar, but different, shapes that may be used to achieve the locking objective of the invention. FIG. 8*c* illustrates an example cam that is similar to the design illustrated in FIG. 7*c* but differs in that there is no optional second convexly rounded section. FIG. 8*d* illustrates an example cam that is similar to the design illustrated in FIG. 7*a* but differs in that its section 68, which acts as a brake to stop the tool from slipping off of the sweet spot is neither straight nor is it convexly curved, but has its perimeter, which follows and is adjacent to the shoulder, concavely shaped. In this design, it is the pair of discontinuities between the concave section of the perimeter and perimeter sections adjacent to it that acts as a brake, stopping the cam from slipping off of the sweet spot. As explained above and as illustrated in FIGS. 9*b* and 9*c*), the convexly curved section of the cam (such as shoulder section 52 of the cam provides for the cam to be rotated about the curve of section 52 as the installer applies force to the handle until the point of maximum compression of the tool against the board being installed and straightened is reached, thus, bringing straight perimeter section 54 to be adjacent, parallel, and in contact with the board (See FIG. 9*c*) which locks the handle in place to keep the tool from slipping past the sweet spot. The principles of the present invention make this possible because the cam is fixed to the handle, that is, the cam is not rotatable with respect to the handle. One currently available cam has a straight perimeter edge but cannot lock the tool in the sweet spot position because of the rotability of the handle about the cam/handle connection providing for the handle to be pushed past the point of maximum compression (the sweet spot), as can be understood by the illustration of FIG. 9*a*. The design of the perimeter of the claimed cam combined with the locking fingers and the elongated locking dog provides the grabbing force required to keep the tool from sliding back on the joist, thus, providing maximum straightening force to each board.

Figure 2:
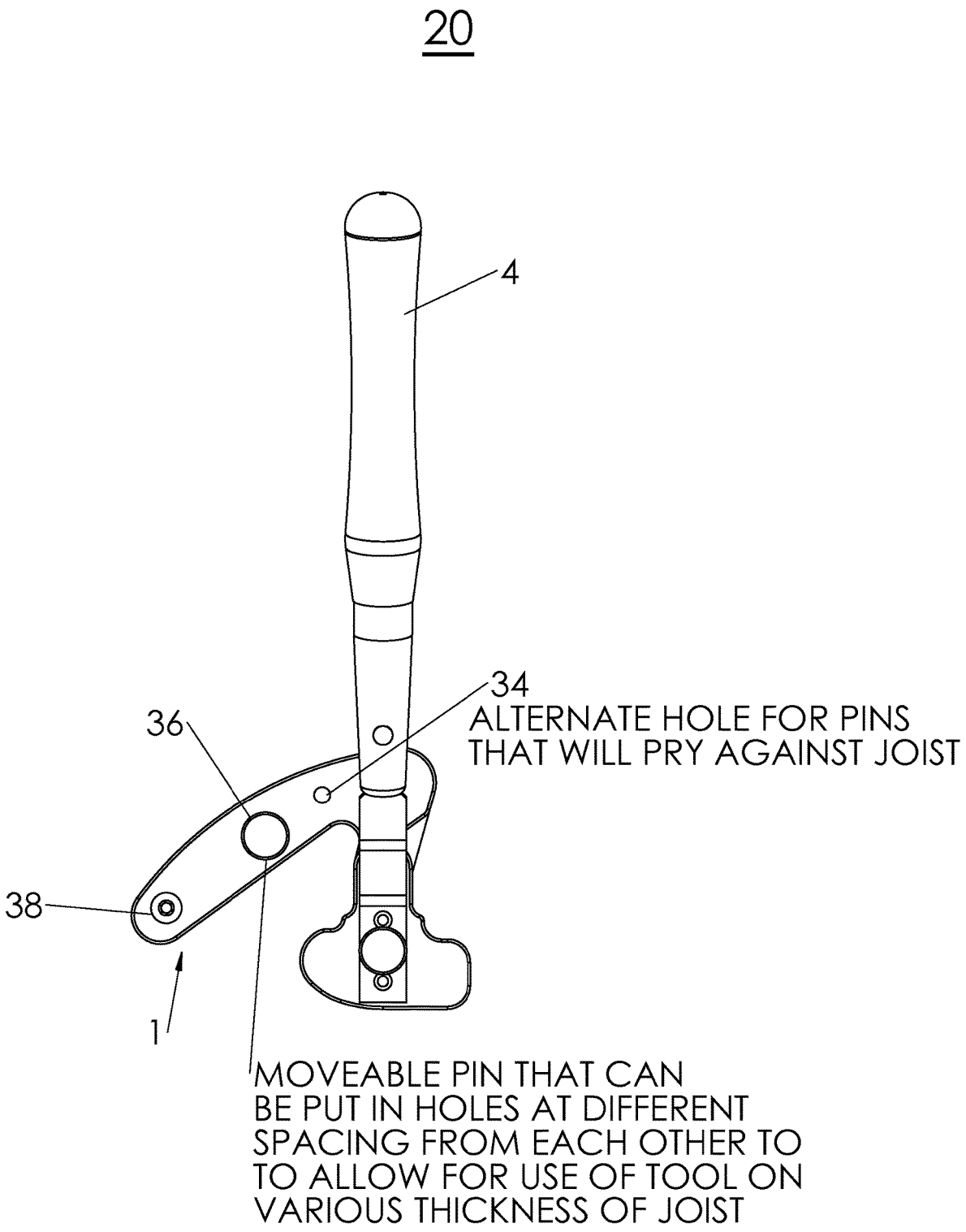
FIG. 2 is a plan view of the fully assembled invention, as shown in FIG. 1.
Figure 3:
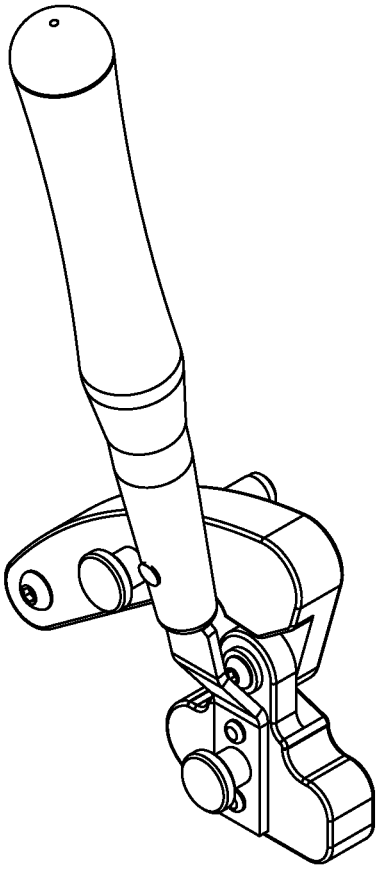
FIG. 3 is a perspective view of the fully assembled invention, as shown in FIG. 2, to show the handle extending over the cam section of the tool.

FIG. 2, a plan view, and FIG. 3, a perspective view, illustrate fully assembled tool 20 with handle 4 extending over cam 6.

Figure 4:
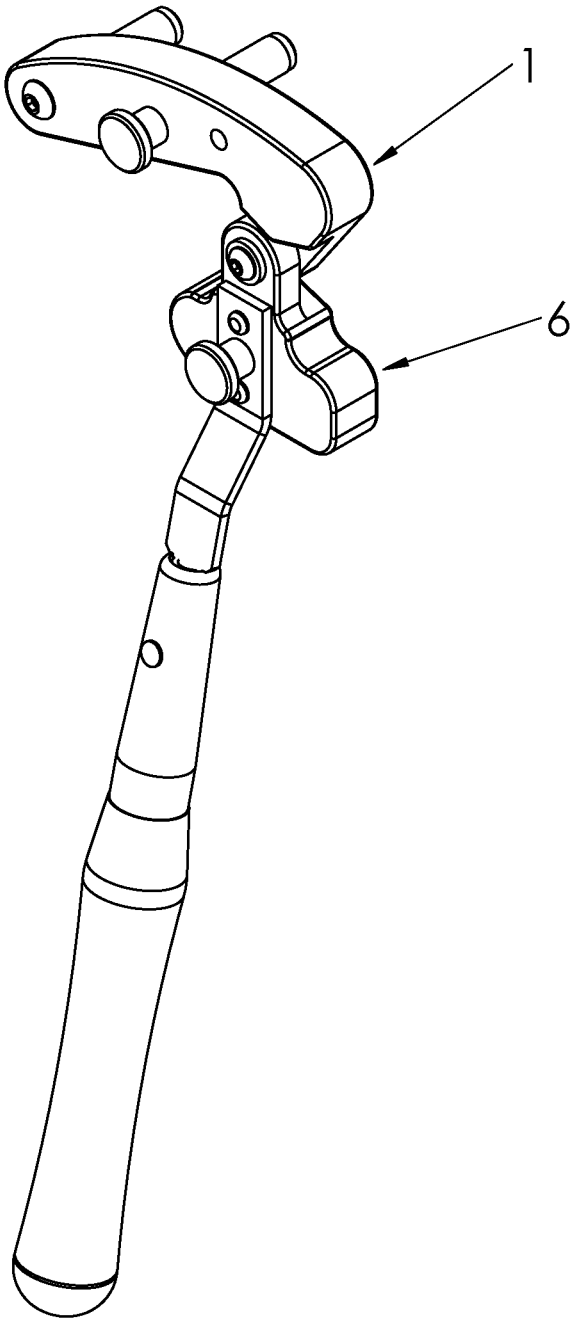
FIG. 4 is a perspective view to show the handle extending away from the cam section of the tool.

FIG. 4, a perspective view, illustrates fully assembled tool 20 with handle 4 positioned to extend away from cam 6 to provide for handle 4 to be rotated a full 180° so that the tool can be used on the first starter board of the deck without the handle hitting the wall. The ability to position the tool handle at 0 degrees and at 180 degrees is within the capability of the embodiment illustrated herein, however alternative embodiments of the device incorporate multi-positioning points of the handle at various degree settings. Other devices attempt to overcome the problem of the prying handle hitting the wall by reversing the handle's position in a such a fashion that the physics of the pivot points of the lever are altered, resulting in a reduction of the force applied to the deck board when used in the reverse handle position, and/or off balances the tool causing it to be awkward to the user attempting to straighten the deck board. The unique design following the principles of the present invention provides for the handle to be reversed and still achieve maximum force and without making the tool clumsy and awkward to use in practice.

Figure 5:
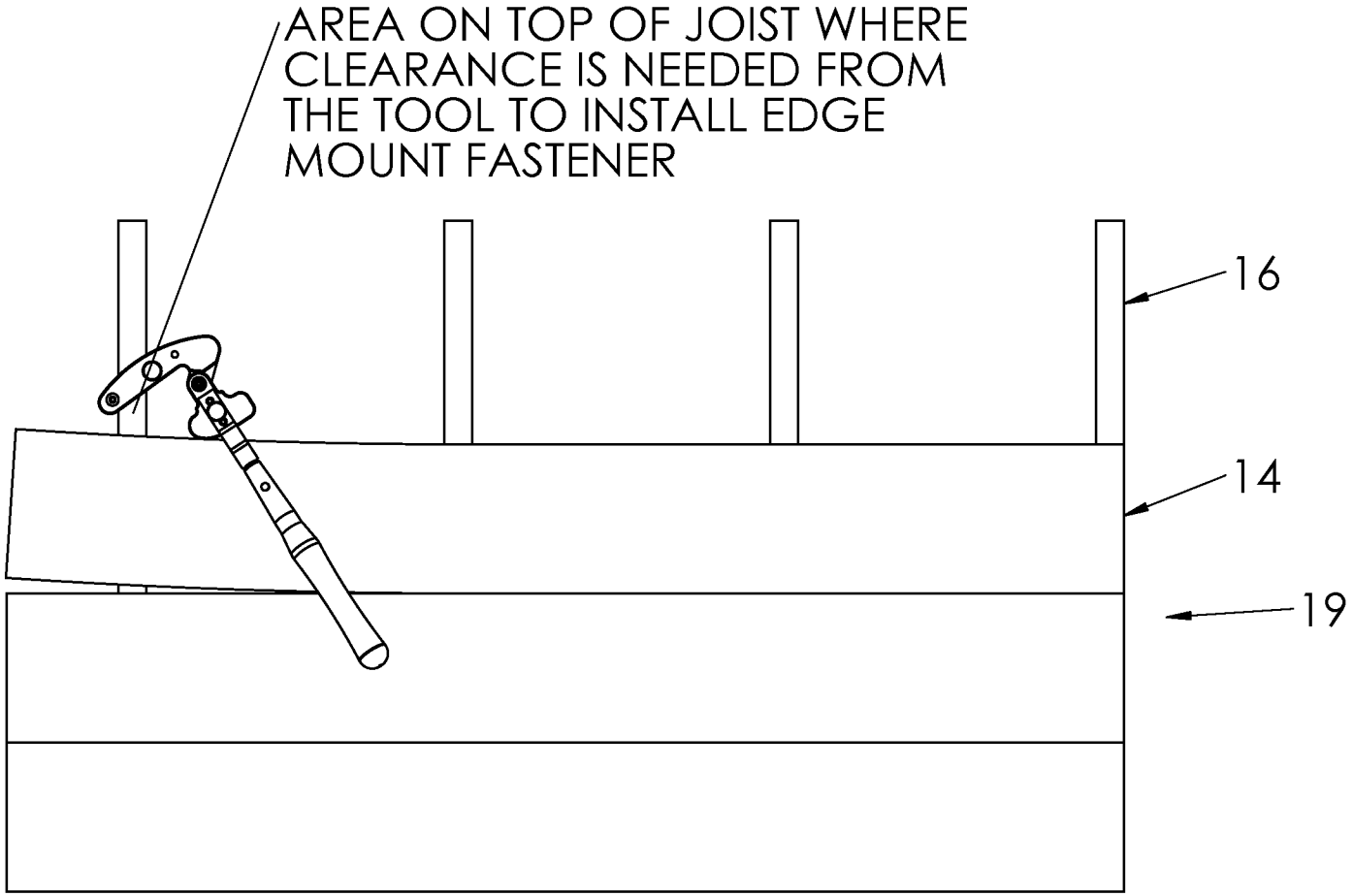
FIG. 5 is a plan view showing the tool of the present invention is use.
Figure 10:
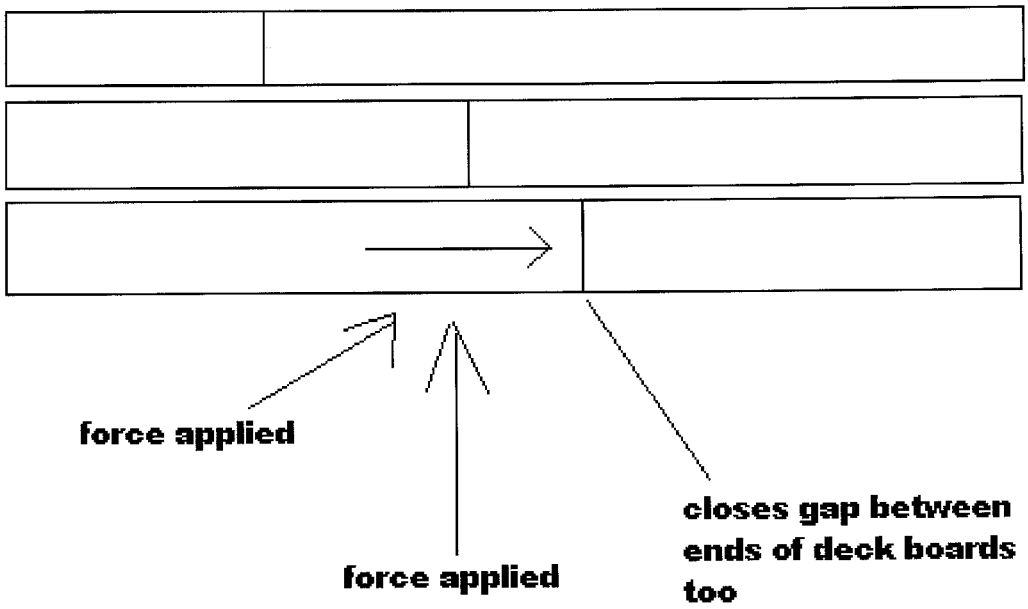
FIG. 10 is a plan view illustrating the directional aspects of the force that the straightening tool applies to a deck board.

FIG. 5 is a plan view showing the tool of the present invention being used, during the installation of deck floor 12, to position and simultaneously straighten floor boards 14 for attachment to support studs (joists) 16. The cam design of the present invention reduces chances of marring the board edge it is straightening and allows for the cam and the locking fingers of the tool to be locked in place providing for the installer's hands to remain free while the device is in use. Additionally, the specially designed shape of the cam of the present invention provides the clearance required for the installation of edge-mount fasteners on the same joist the tool's fingers are grasping. Other deck straightening devices do not allow any or allow only inadequate room for installing an edge-mount fastener while the board is being held straight by a tool. This is an important consideration as edge-mount fasteners are becoming increasingly popular. Current board straightening devices are not able to provide the force required for a tool to fully straighten overly crooked boards, and/or do not have enough "throw" distance to take out a large bend in the board in a single swing of the handle. In instances where the wood is delicate and easily marred, the surface of the joist grabbing (locking) pins of the present tool are smooth. Alternatively, where the finish of the joists is not of concern and where extra pushing force against the deck boards to be straightened is desired, the smooth surface of the joist grabbing (locking) pins may use machine knurled or rough-shaped pins. Moreover, a straightening tool, made according to the principles as taught herein, applies force to the board being straightened in both perpendicular and angular directions which provides not only for straightening the board, but also for assuring that the abutting ends of the deck boards are positioned as closely as possible to each other (see FIG. 10).

The foregoing description, for purposes of explanation, uses specific and defined nomenclature to provide a thorough understanding of the invention. However, it will be apparent to one skilled in the art that the specific details are not required in order to practice the invention. Thus, the foregoing description of the specific embodiment is presented for purposes of illustration and description and is not intended to be exhaustive or to limit the invention to the precise form disclosed. Those skilled in the art will recognize that many changes may be made to the features, embodiments, and methods of making the embodiments of the invention described herein without departing from the spirit and scope of the invention. The present invention is not limited to the described methods, embodiments, features or combinations of features but include all the variation, methods, modifications, and combinations of features within the scope of the appended claims. The invention is limited only by the claims.

What is claimed is:

1. A board straightening tool, comprising:

a handle;

a handle adapter, detachably coupled to said handle;

a cam, detachably coupled to said handle adapter by at least one dowel pin and a threaded insert, wherein said cam comprises a bow section and a key way section extending from said bow section, wherein the bow section comprises a first section designated as a shoulder of said cam, said first section comprising of a convexly rounded corner perimeter, a second section, adjacent to said first section, wherein the second section comprises any one of: a straight perimeter, a concavely curved perimeter, a combination perimeter comprising a convex perimeter followed by a concave perimeter, a third section, adjacent to said second section, wherein said third section comprises any one of: a convexly curved perimeter, a truncated perimeter; and a locking dog, rotatably attached to said key way section of said cam, wherein said locking dog comprises removable and adjustable locking fingers, wherein each of said locking fingers may be positioned in any one of: spaced apertures of said locked dog or positions in a sliding slot of said locking dog.

2. The board straightening tool, as defined in claim 1, wherein said shoulder contacts the board being straightened after said locking fingers stabilize said locking dog about a joist, wherein said shoulder is a part of said cam which contacts the board before other parts of said cam.

3. The board straightening tool, as defined in claim 2, wherein a second section of said cam bow section is the next section of said perimeter to contact the board being straightened.

4. The board straightening tool, as defined in claim 1, wherein said cam is coupled to said locking dog by an attachment.

5. The board straightening tool, as defined in claim 4, wherein said attachment is the fulcrum that multiplies a force applied to said handle increasing the force being applied to the board by said shoulder.

6. The straightening tool, as recited in claim 1, wherein said handle adapter is detachably and non-rotatably attached to any one or more of: said cam, said handle.

7. The straightening tool, as recited in claim 1, wherein said handle adapter is able to be detached and reattached in a non-rotatable manner to be used in 180 degree directionally opposition positions.

8. The board straightening tool, as recited in claim 1, wherein said handle is adjustable to be positioned for use in multiple varying degrees from the tool body.

9. The straightening tool, as recited in claim 1, further comprising said cam having a positive radii curved perimeter section adjacent a perimeter section having a radii value of infinity keeping the tool from slipping past the spot of greatest application of force by the tool.

10. The straightening tool, as recited in claim 1, further comprising said cam having a positive radii curved perimeter section adjacent a perimeter section having a negative radii keeping the tool from slipping past the spot of greatest application of force by the tool.

11. The straightening tool, as recited in claim 1, further comprising said cam having a positive radii curved perimeter section adjacent a perimeter section having a positive radii keeping the tool from slipping past the spot of greatest application of force by the tool.

12. The straightening tool, as recited in claim 1, wherein said cam further comprises a perimeter shaped of various lengths and arcs of curves or of various lengths and arcs of curves and straight sections.

13. The straightening tool, as recited in claim 1, further comprising said cam having an offset rotatable attachment to the locking dog.

14. The straightening tool, as recited in claim 1, wherein said locking fingers can be positionably adjusted to grasp varying joist sizes.

15. The straightening tool, as recited in claim 14, wherein said locking fingers can grasp a joist stabilizing said locking dog so that when said shoulder of said cam is wedged against the board said offset rotatable attachment acts as a fulcrum to multiply the force that an installer applies to said handle.

16. The straightening tool, as recited in claim 1, wherein said locking fingers are constructed from a knurled metal or are constructed having a smooth surface providing for a reduction of marring of the joist.

17. The straightening tool, as recited in claim 1, wherein said cam is rotatably attached to said locking dog by an offset pivot pin wherein said pivot pin's offset provides access required to install the locking finger dowel pins on the joist against which the straightening tool is to be braced.

18. A board straightening tool comprising:

a handle detachably coupled to a handle adapter;

a cam non-rotatably attached to said handle adapter by at least one dowel pin and a threaded insert, wherein said cam comprises a key-shaped perimeter, said perimeter comprising a first section designated as the shoulder, wherein the first section comprises a convexly rounded perimeter and a second section, wherein the second section comprises any one of: a straight perimeter, a concavely rounded perimeter, a combination perimeter comprising a convex perimeter followed by a concave perimeter, wherein the second section prevents said shoulder from slipping; and a locking dog, rotatably attached to said cam said locking dog having scissors-like compression grasping pins, wherein each of said grasping pins is held in place by a button head screw, and wherein each of said grasping pins may be positioned in any one of: spaced apertures of the locked dog or positions in a sliding slot of said locking dog.

19. A board straightening tool, comprising:

a handle;

a handle adapter, detachably coupled to said handle;

a cam, detachably coupled to said handle adapter by at least one dowel pin and a threaded insert, wherein said cam comprises:

a first section designated as a shoulder of said cam, said first section comprising of a convexly curved perimeter, a second section, adjacent to said first section, wherein the second section comprises any one of: a straight perimeter, a concavely curved perimeter, a combination perimeter comprising a convex perimeter followed by a concave perimeter, wherein said second section prevents slippage of said cam when it is wedged against a board, a third section, adjacent to said second section, wherein said third section comprises any one of: a convexly curved perimeter, a truncated perimeter; and a locking dog pivotably coupled to said cam.

* * * * *